US006835169B2

(12) United States Patent
Tamaribuchi

(10) Patent No.: US 6,835,169 B2
(45) Date of Patent: Dec. 28, 2004

(54) ERGONOMIC HANDHELD EXERCISERS

(76) Inventor: Stephen K. Tamaribuchi, P.O. Box 1375, Rancho Cordova, CA (US) 95741

( * ) Notice: Subject to any disclaimer, the term of this patent is extended or adjusted under 35 U.S.C. 154(b) by 7 days.

(21) Appl. No.: 10/194,735

(22) Filed: Jul. 11, 2002

(65) Prior Publication Data

US 2004/0009858 A1 Jan. 15, 2004

(51) Int. Cl.[7] ..... A63B 2/00
(52) U.S. Cl. ..... 482/139; 482/44; 482/49
(58) Field of Search ..... 482/44–50, 139, 482/148; 116/110.1

(56) References Cited

U.S. PATENT DOCUMENTS 4,711,445 A * 12/1987 Whitehead ..... 482/49
5,820,522 A * 10/1998 Smallwood et al. ..... 482/49
5,979,015 A * 11/1999 Tamaribuchi ..... 16/110.1
6,652,421 B1 * 11/2003 Chen ..... 482/49

* cited by examiner

*Primary Examiner*—Glenn E. Richman
(74) *Attorney, Agent, or Firm*—Mark C. Jacobs

(57) ABSTRACT

Left and right hand exercisers are formed based upon a modification of the handgrips disclosed and claimed in U.S. Pat. No. 5,979,015, wherein a throughbore is made through the grip, generally vertically through the elongation of the grip, at an angle between 82 and 88 degrees. A flattened tube of nylon webbing, or equal, is disposed through the throughbore, and is either connected to itself to form an endless loop spaced from the body of the grip in one embodiment. In another embodiment, the webbing passing through the bottom end of the grip is retained in place by one of several means. The end of the webbing emanating from the top of the grip may be attached directly to an elastic tube or band, or to a swivel split ring. If the latter, cables or other devices can be appended to the split ring as is known to the art.

16 Claims, 5 Drawing Sheets

ERGONOMIC HANDHELD EXERCISERS

RELATION TO OTHER PATENTS AND PATENT APPLICATIONS.

Applicant is the inventor of U.S. Pat. No. 5,979,015, issued Nov. 9, 1999, the disclosure of which patent is incorporated herein by reference.

FIELD OF THE INVENTION

This invention pertains to two embodiments of a handheld exerciser, both of which embodiments employ the grips of U.S. Pat. No. 5,979,015.

BACKGROUND OF THE INVENTION

It is well known that the majority of the muscles of the body are intended to operate on a linear direction when moved, or exertion takes place. If the skeletal frame is misaligned when muscle action transpires, the body is readily displaced. Should one of either the shoulder or hips become displaced during musculature activity, the displacement of either of these two key elements of the body will also appear to have been stressed.

Not only in reaching and grabbing motions, but in exercise activities is it important to keep the body and its parts from getting into unstable positions. Thus I have now extended the use of my grips invention into becoming hand-held exercisers which when help properly and used as described herein, will result in the proper use of the biceps, the triceps, and the abdominal muscles.

By incorporating the resistance tubing or resistance bands one can utilize this invention to carry out triceps and lat pull downs, crunches and biceps curls among other exercises, all while maintaining proper upper body positioning.

It is important for the reader to understand that the grips have a left hand unit and a right hand unit. The grip for one hand is not interchangeable for use by the opposite hand. If a person were to spread out their left hand in front of a mirror, the virtual image seen would be the right hand. In the same manner, the left grip is a mirror image of the right grip. Just as a left hand leather glove does not properly fit the right hand, so too with the original grips, and the grips as modified to form this invention. One must use the right hand handgrip in the right hand, and the left hand grip in the left hand.

As used herein the term right hand exerciser means a grip for the right hand of a person, modified to be used in this invention. Since these exercisers are used by the hands as opposed to the feet, they are referred to as hand exercisers. Thus, we have left hand and right hand exercisers in this invention.

SUMMARY OF THE INVENTION

This invention pertains to hand-held exercise equipment based upon the grips of U.S. Pat. No. 5,979,015 which grips have been bored through and have a flexible band of webbing disposed therethrough. The flexible webbing band can traverse one of several paths. It can be tied off at the bottom of a first grip and be connected to one end of the length of an elastic band or ribbon; or connected to one end of the length of flexible elastic tubing. In such instances the grip used by the second hand would be fashioned in a like manner to the opposite end of the flexible elastic band or ribbon or to the second end of the length of flexible elastic tubing. The variant of this first embodiment has a split ring tied into position of the flexible elastic band or ribbon, or even of flexible tubing at about the midpoint thereof. Other cables, ropes or ribbons can be attached to the split ring for the specific exercise desired. In the second embodiment, the flexible webbing band or ribbon passes through the grip and loops back to itself in an endless loop.

DESCRIPTION OF THE PREFERRED EMBODIMENT

For convenience, in order to better understand the exercisers of this invention, a short discussion of the patented grip 10 utilized in this invention will be described as shown in FIG. 1 extending generally upright, although its orientation might vary for different exercises.

Figure 1A:
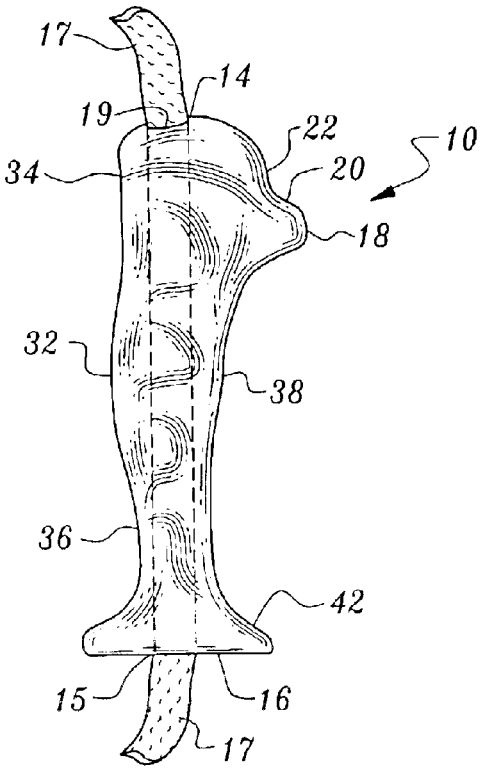
FIGS. 1A, 1B, 1C, and 1D are a front, right side, left side, and rear views respectively of the body section of the right hand exercisers of this invention.
Figure 1B:
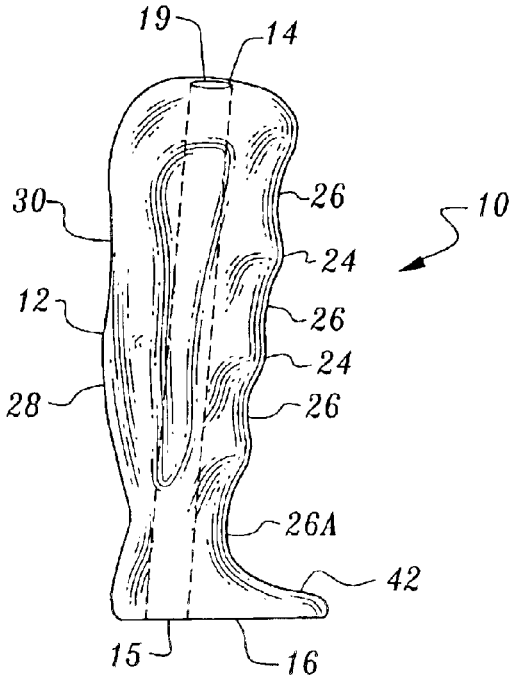
Figure 1C:
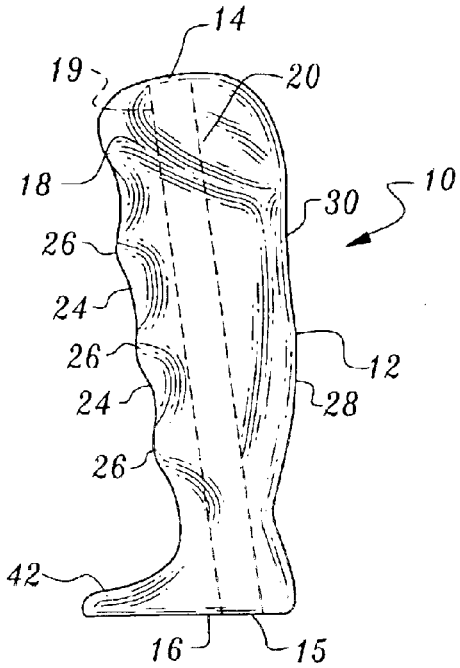
Figure 1D:
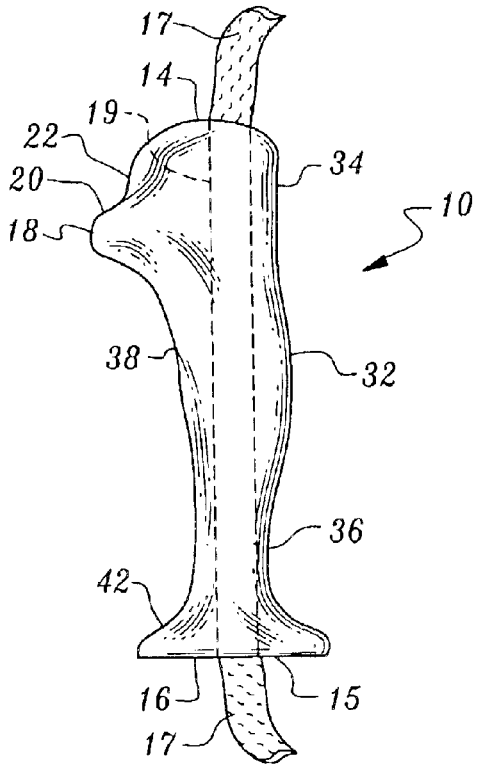
Figure 12:
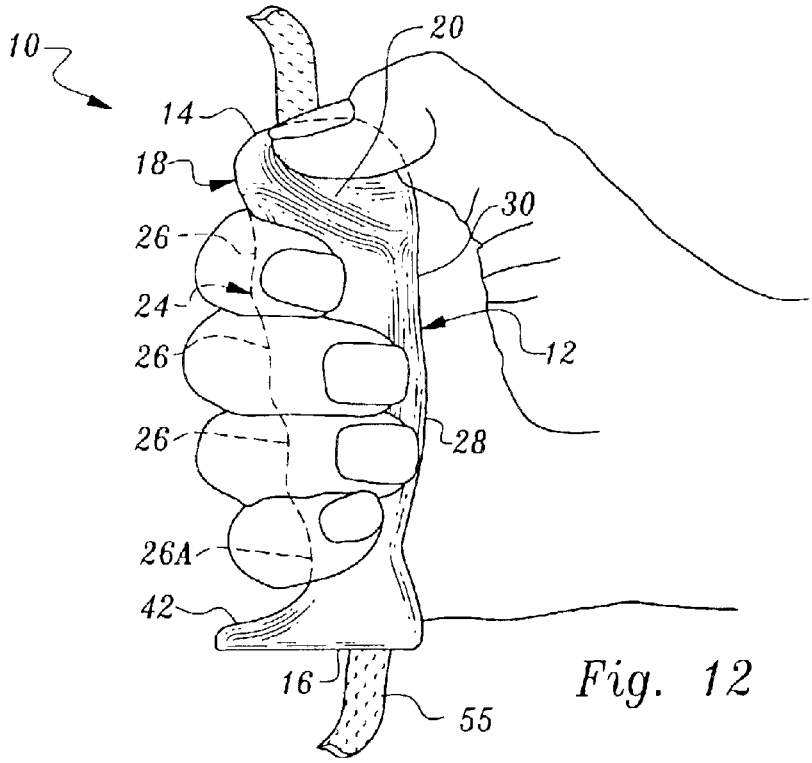
FIG. 12 is a diagrammatic closeup view showing a human right hand correctly holding the grip 10 forming part of this invention.

More particularly, as shown best in FIGS. 1A, 1D, and 12, the illustrated grip 10 is formed at a first or upper end 14 with a thumb support 18 that includes a generally upwardly facing thumb support surface or ledge 20. That surface 20 extends outwardly to one side of the base 12 and slightly downwardly; the surface 20 helps locate and support the thumb of the user extending generally forwardly and to the side, with the thumb bent and the end digit inclined somewhat downwardly. The thumb support 18 also includes a generally upstanding locating surface 22 that extends generally transversely to the support surface 20 at the forward/sideward direction or angle noted above. The locating surface 22 engages the side of the gripping thumb. Surfaces 20 and 22 combine to locate and maintain the gripping thumb in the desired comfortable angled and bent position.

FIG. 12 shows a hand wrapped around the grip 10 as viewed from the left; the hand is not significantly tilted either toward the thumb or the little finger. Thus the hand and wrist are in a generally neutral position when the hand grasps the grip 10.

As shown best in FIGS. 1B, 1C, and 12, the illustrated grip 10 has a generally forwardly facing front edge portion 24 having individual indentations or grooves 26 each accommodating one of the fingers of the gripping hand. This forward edge portion 24 generally engages so as to position and support the first joint (close to the palm) of each of the side fingers. This in turn tends to determine the alignment of the knuckles and facilitates aligning those knuckles in a generally straight line as viewed from the back of the hand.

In particular, there is a slight depression 30 in the surface 28 to accommodate the portion of the palm adjacent to and just forwardly of the thumb.

The side surface 32 of the grip 10 between the forward and rearward edge portions 24, 28, which engages the palm of the hand adjacent to the fingers, is suitably contoured and selectively recessed to comfortably receive the joints between the fingers and the bones of the hand and to allow the grip to be squeezed without misalignment of the knuckles as discussed above. In particular, there is a specific upper recess or depression 34 to accommodate the joint between the first finger and the second metacarpal of the hand. Further, the side palm engaging surface 34 has a lower recess 36 to accommodate the heel of the hand, i.e., the joint between the little finger and the adjacent metacarpal. This last accommodation is particularly significant as it contributes and facilitates the extended or increased contraction of the little finger relative to the other fingers as described above. In this connection, at the forwardly facing front end portion 24 of the grip, the lowermost groove 26A for the little finger is enlarged to facilitate the additional contraction.

The opposite side surface 38 of the grip 10 is generally flat as shown in FIGS. 1A, and 1D. That surface 38 extends in a generally upright plane that is at a light sideward angle from the forwardly facing edge portion 24, to provide a comfortable positioning and resting stop for the ends of the gripping fingers. In this connection, the underside of the thumb support 18 is formed with a smooth angled undersurface 40 to provide a comfortable support and resting place for the end of the first finger of the gripping hand. This surface extends rearwardly at a slight outward angle outwardly from the forwardly facing edge portion 24.

The lower end 16 of the grip 10 is provided with an enlarged end portion 42 which serves as a guide and limit stop for the hand when it reaches for and engages the grip.

While the grip 10 as modified for use in this invention will accommodate some variation in hand size, the size of the grip may be varied to fit different sized hands, particularly for women and children with normally smaller hands.

Figure 9:
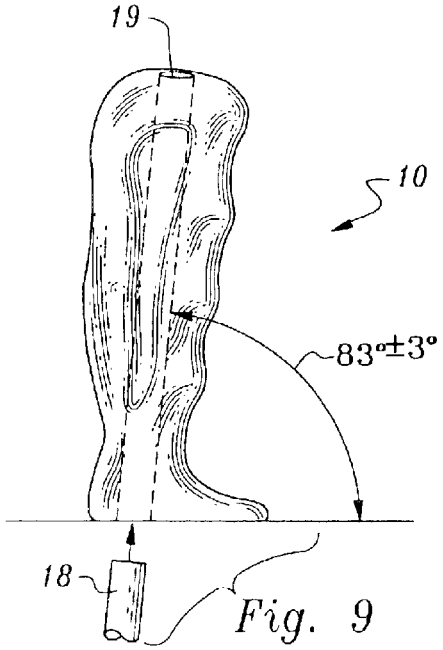
FIG. 9 is a diagrammatic view to illustrate the angle of penetration of an elastic band through a grip.

The grip 10 shown in FIGS. 1A–1D have been modified from the grip shown in the aforementioned U.S. Pat. No. 5,979,015, to suit the purposes of this invention. Thus, the grip 10 seen here has a throughbore 19 which extends through the full length of the grip 10 from upper opposed end 14 through the bottom opposed end 16. Location 15 indicates the spot where a metal ring or other retainer may be placed or a knot tied at the lower end of the grip 10. Bore 19, as per FIG. 9, is seen to be made at an angle of about 83 degrees to the horizontal. The angle may vary ±3 degrees and still work acceptably. Shown in FIG. 1A is flattened tubular webbing 17, preferably made of nylon. Such material is readily available in the marketplace from such companies as REI and is sold under the brand name Blue Water. This flattened webbing is primarily used by climbers.

Figure 2:
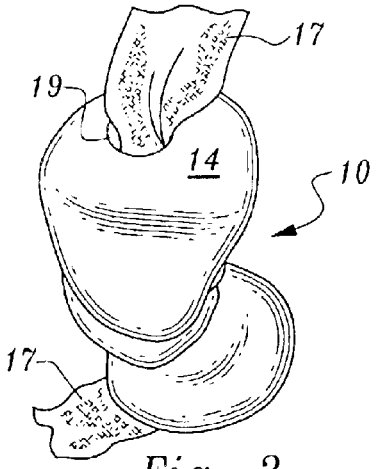
FIG. 2 is a top perspective view of the left hand exerciser's body section. The right-handed exerciser has a body portion that is a mirror image of this view.

FIG. 2 also illustrates that webbing 17 passes through the bore 19 in the upper opposed end 14 of the grip 10.

Figure 3:
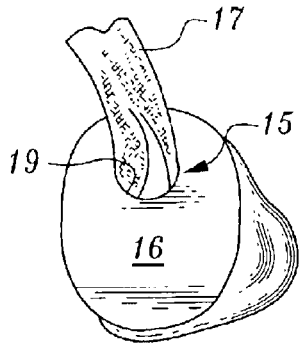
FIG. 3 is a bottom plan view of the body portion of the left-handed hand exercisers of this invention. The bottom plan view of the left-handed unit's body portion is a mirror image thereof.

FIG. 3 is the opposite or lower end 16 of the left-handed handgrip. Location 15 is at the end of bore 19 and signifies the location where a knot, metal ring or other member may be placed for retention.

Figure 4:
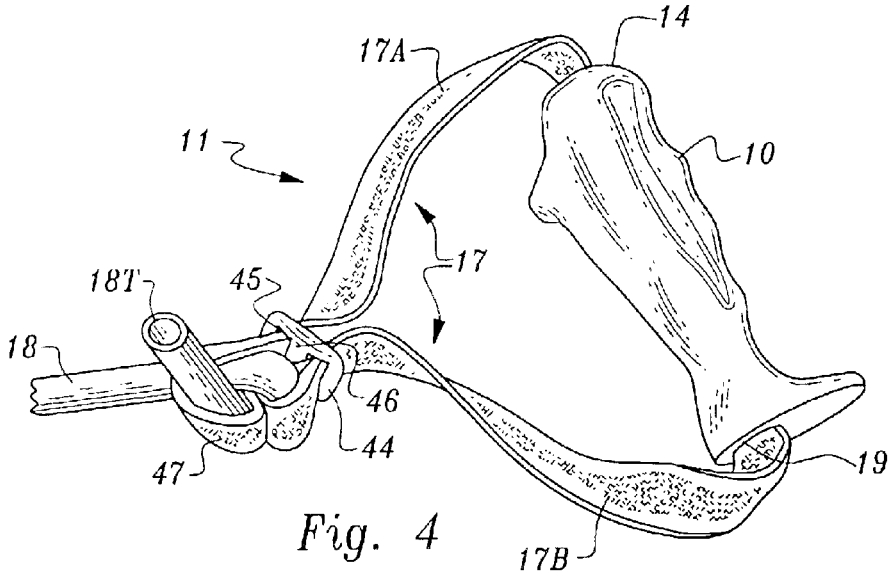
FIG. 4 is a right rear perspective view of the right portion of the exerciser of the first embodiment of this invention.

In FIG. 4, the first embodiment of the invention 11 is seen. Here grip 10 has a webbing section 17 passing through the full length of the grip of throughbore 19. While the webbing is one continuous piece 17, it will be discussed in segments for ease and understanding, and ready reference to the figures. Thus, segment 17A seen emanating from the upper end 14 of the grip passes through one of two slots 45 in retainer member 44. The retainer member, which is seen here is rectangular in configuration, is divided in half by divider 46, in one direction. There is no directional orientation to this retainer member.

The other segment 17B passes from the bore 19 at the lower end 16 of grip 10 through the second slot in retainer member 41. A finite length of flexible tubing 18 has one of its terminii folded into a U and retained in position by webbing 17. The retainer member's divider 46, preferably has teeth facing one way to grab and retain the webbing passing through each of the two slots as shown. Upon being held in the retainer member, the webbing is seen to have formed an interrupted endless loop through the grip and the retainer member. In FIG. 4, only one terminus of the tubing 18 is shown knotted and retained by webbing 17. The second terminus of the elastic tube (preferably of latex) 18 is retained in the same manner by the second grip. Neither the second grip nor the second end of the flexible tubing 18 are seen in FIG. 4. This loop of tubing through the webbing contains between 6 and 8 inches of tubing such that the loop formed is spaced from the body of the grip 10 and therefore does not lie on the hand during usage. The entire length of tubing utilized is between 22 and 28 inches in length.

Figure 5:
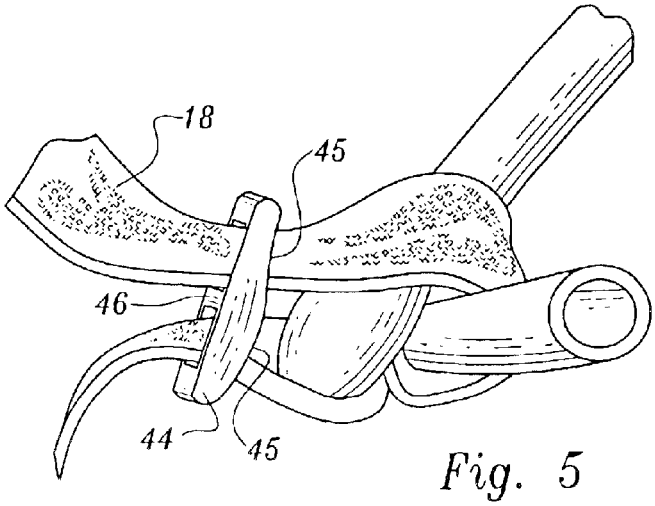
FIG. 5 is a closeup view of a connection forming part of this invention's first embodiment.

FIG. 5 is a closeup of the retention of webbing 18. Here both slots 45 are seen as is the divider 46. There is no rocket science to the knot made between the webbing and the tubing. Any conventional knot will suffice for this purpose.

Figure 6:
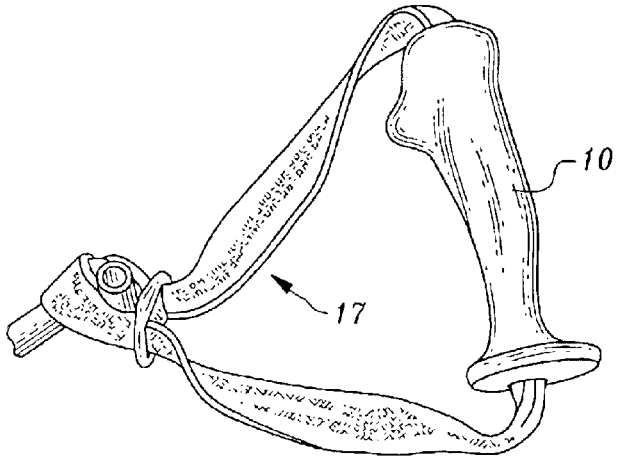
FIG. 6 is a left front perspective view of the right portion of the exerciser of the first embodiment of the invention.
Figure 7:
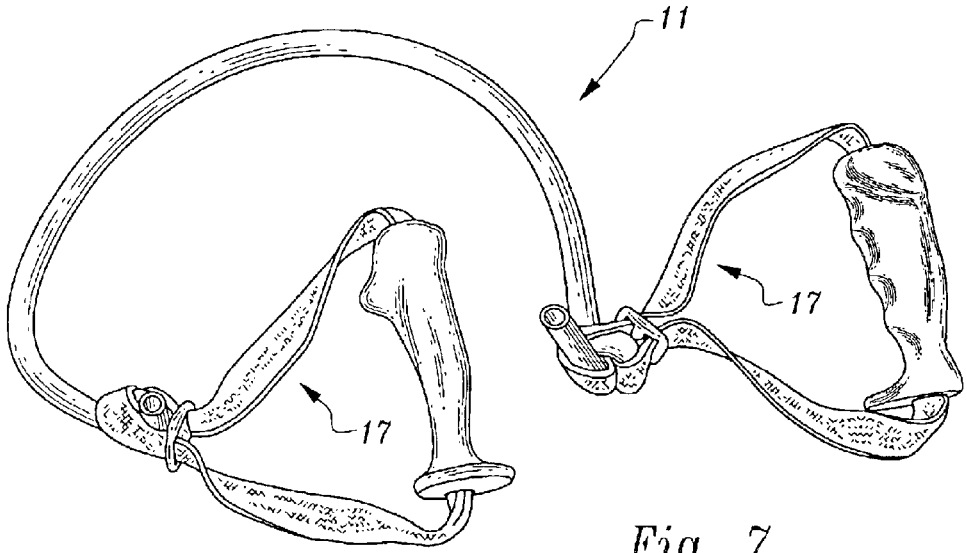
FIG. 7 is a plan view of the left side of the right-handed exerciser and of the left front of the left hand exerciser of the first embodiment of this invention.

FIG. 6 is a right rear perspective view of the grip 10 webbing 17 seen in a front perspective view in FIG. 7, no further discussion of this view is required.

FIG. 7 is a perspective view of the left side of both of the left grip and the right grip, both of which are connected to a finite length of flexible tubing. Discussion supra.

Figure 8A:
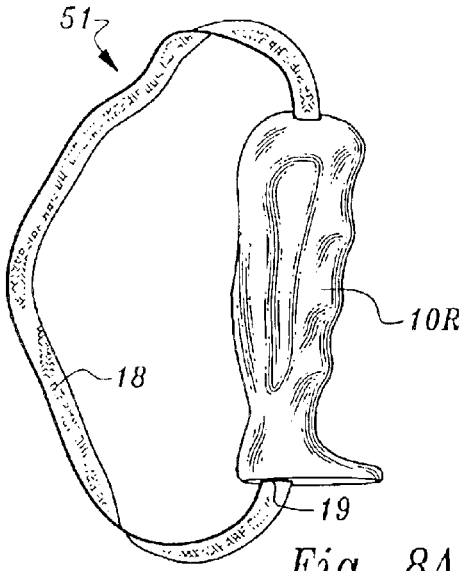
FIG. 8A is a plan view of the right hand exerciser of the second embodiment of this invention with the exterior surface of the body showing.
Figure 8B:
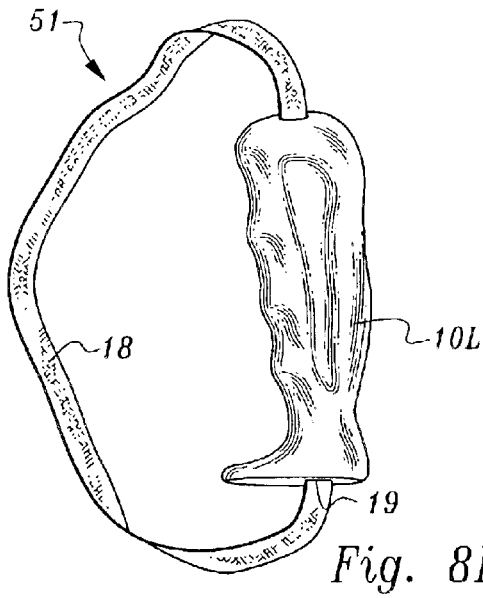
FIG. 8B is a plan view of the left-handed exerciser of the second embodiment with the exterior surface of the body portion showing.

In FIGS. 8A and 8B the two grips for the left hand and right hand are both seen and designated 10R and 10L, respectively. Each of them forms part of the second embodiment 51 of this invention. In this embodiment, webbing 18 passes though bore 19, tied into a knot, and the now endless looped webbing 18 has its knot forced up into bore 19 primarily for aesthetics. Webbing 18 is strong and flexible but not elastic in nature. In the alternative, the two ends of the webbing may be fused or adhesed and then forced into throughbore 19.

It is seen that webbing 51 passes through bore 19 of each of the handgrips, as is seen in FIG. 3 et seq. The two ends of the webbing may be secured to each other as is discussed herein, per FIG. 8, or the two ends can be used separately as is shown in FIG. 4. In FIG. 4 they are tied in a sailor's knot.

In FIG. 9, the angle of passage of the webbing as it would pass through bore 19 is illustrated. The angle is seen to be 83 degrees, ±3 degrees. This range is specified as it is often difficult to machine a multi-surface complex rubber unit in repetitive fashion to close tolerances. It has been found that when the bore is between 82 and 88 degrees from the vertical that excellent results are obtained when the piece of equipment is used by persons in the field for exercise purposes.

Figure 10:
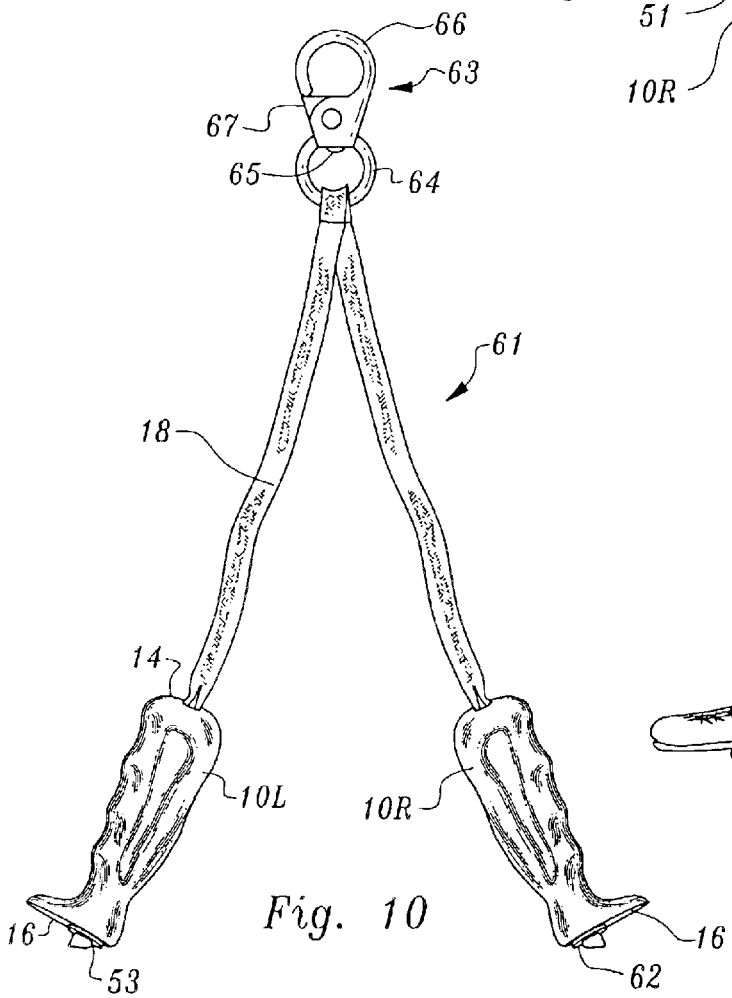
FIG. 10 is a perspective view of third embodiment of this invention.

In FIG. 10, the third embodiment of this invention is seen. One end of the webbing of a finite length usually from 12 to 18 inches passes through the left grip via the throughbore (not seen) and retained at the lower end thereof by a chrome ring 53 through which the webbing's terminus is looped through and stitched back to the rest of the length of webbing, thereby forming a loop over the ring.

The length of webbing 18 exits at the upper end 14 of the first grip 10L and is looped around and through ring 64 to secure one to the other. Any conventional knot can be employed.

The lower ring 64 is attached to and rotates around swivel pin 65 of the swivel split ring 63. This swivel split ring 63 includes a broad arcuate segment 66 and a pivot jaw 67. Such swivel split rings 63 are readily available in the marketplace from several manufacturers. Typically, hardware stores carry them.

Once looped around and over lower ring 64, the webbing segment passes downwardly through the right grip 10R and is secured in place at the lower end 16 by a retainer designated 62. Here webbing 18 is looped through the retainer, held by the teeth of the retainer and passed through the retainer again, in a manner similar to FIG. 5. In the alternative, the webbing segment can be sewn back over itself for retention in the same manner as was done with the left grip using a second ring 53. Thus two distinct methods maybe employed to retain the end of the webbing segment or webbing section at the lower opposed end of the grip.

The fixed arcuate segment 66 can be attached to various things, such as flexible tubing among other items or directly to a connection on a wall or ceiling. This is an excellent piece of equipment for the strengthening of the arm muscles.

Figure 11:
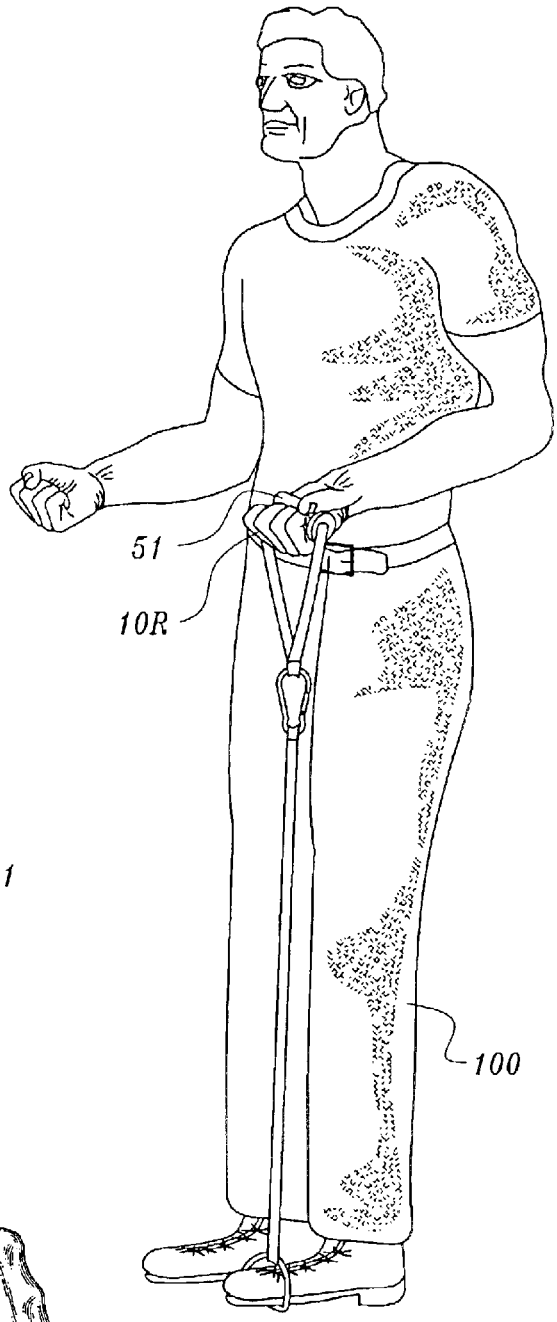
FIG. 11 is a perspective view illustrating the use of the variant of FIG. 10 to do a one-armed biceps curl.

FIG. 11 shows a person 100 who has placed the tubing of the second embodiment beneath his foot, under the shoe, and within his fist 10R. He could hold one of the grips 51, though not shown, in a fixed position while tugging on the second grip to carry out a one-armed biceps curl. Or, a second same piece of equipment shown in the left hand could be employed simultaneously in the right hand as may be desired.

FIG. 12 shows the correct position for holding the grip during exercises. The handgrip shown applies to any embodiment of the grip, and is independent of whether tubing or webbing passes through the grip. In this figure, elastic tubing 55 is passed through bore 19, as is within the scope of the invention. Such tubing can be tied off to form an endless loop in the manner shown in FIG. 8B. The loop could be placed over a doorknob, or over a horizontal rod and then stretched by the movement of the arm to overcome the resistance. Other exercises are within the skill of those who operate in the field of exercise training.

Figure 13:
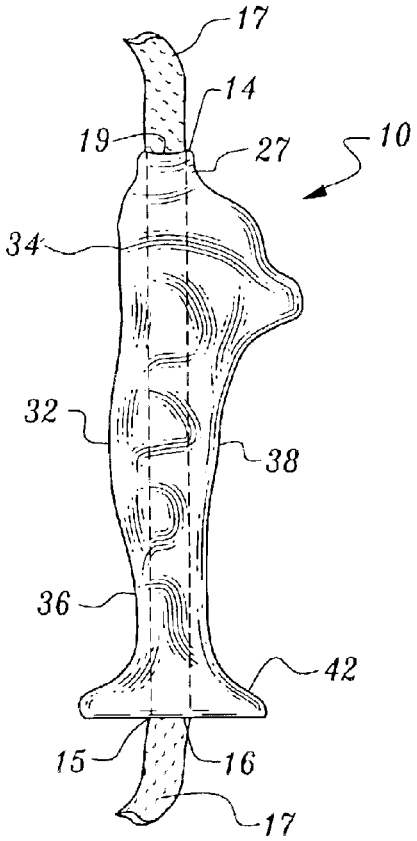
FIG. 13 is a closeup diagrammatic view related to FIG. 1, but showing a variant of the grip aspect of this invention.

FIG. 13 illustrates the grip shown in FIG. 1 but to which a minor modification has been made. An upstanding section 27 has been added at the upper opposed end, which upstanding section has a central bore in aligned communication with throughbore 19 such that the entire bore is still designated 19. The purpose of this upstanding section is to keep the webbing or tubing passing therethrough away from the hand.

Figure 14:
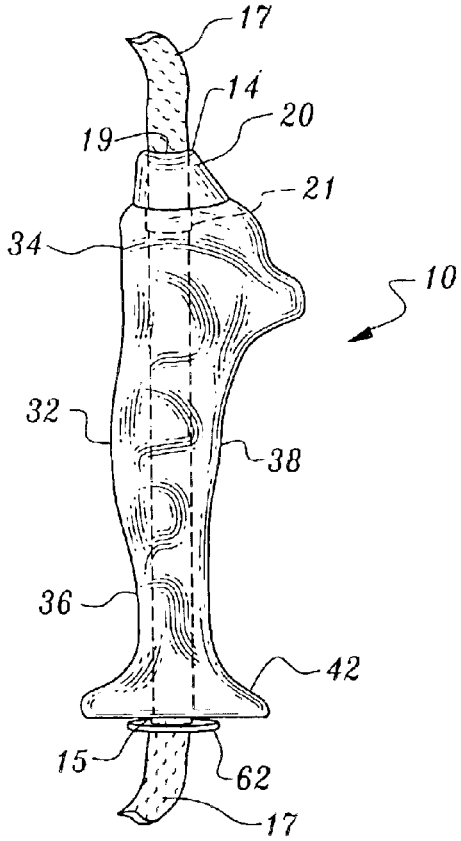
FIG. 14 is a closeup diagrammatic view similar to FIG. 13, but showing an attachment to the grip to create the same effect as the modification shown in FIG. 13.

FIG. 14 is similar to FIG. 13, but instead of modifying the grip, an adapter 20 having a downwardly depending cylindrical insert section 21 to retain the adapter in position by friction fit through bore 19 is shown. The adapter 20 may be made of plastic or metal such as aluminum, or even hard rubber. The adapter 20 serves the same purpose as the upstanding section shown in previous FIG. 13. It is also to be seen that carbon fibers may be employed for structural support in the construction of adaptor 20. A tightener 62 is also shown in FIG. 14. Such may be employed to retain the webbing, such that a glued terminus folded back becomes unnecessary. The tightener 62 serves to prevent slippage. See FIG. 10 for its use as well. The tightener is used in conventional manner by placing the first end of the webbing down through the first slot and up through the second slot, as if one were tightening a fanny pack strap. Further discussion is deemed unnecessary since the operation would be somewhat similar to that illustrated in FIG. 4 for the use of retainer ring 44.

As to the third embodiment previously discussed, the swivel split ring 62 can be connected to any cable resistence system, such as Pilates, or the Total Gym system, both of which products are readily available in the marketplace. When so attached, the user has the ability to indicate greater activity in the arms by exercising the biceps, triceps, and deltoid muscles as well as the pectorals of the chest among others.

It is also to be understood that the first and the third embodiments of the invention can also be employed for physical therapy purposes for those who suffer from reduced use of an arm.

As to the second embodiment of the invention wherein the webbing forms a continuous loop through the grip per FIG. 8, they are utilized in the following manner:

The unit is attached to a Total Gym® or Bowflex®, apparatus with a spring clip. Then the user can do arm curls, rows, or crossovers; basically all the same movements as one would do without the improvement of this invention. The addition of this invention provides better muscle improvement, and reduction of pressure on the shoulders and upper back.

The reader is reminded that the ergonomic hand exercisers of this invention each have a left hand model for use in the left hand and a right hand model for use in the right hand, when the finite section of webbing or tubing's end are connected to form an endless loop, the one-piece units of exercise equipment embodiments of the invention, wherein the right hand exerciser and the left hand exerciser are joined, should be used only with the right handgrip for the right hand and the left handgrip for the left hand.

Since certain changes maybe made in the described apparatus without departing from the scope of the invention herein involved, it is intended that all matter contained in the above description and shown in the accompanying drawings shall be interpreted as illustrative and not in a limiting sense.

I claim:

1. An ergonomic hand exerciser which comprises: a modified elongated handgrip for being held in a hand of a user, which handgrip when disposed generally upright and gripped with the thumb of the user's hand prevents pronation of the first metacarpal and the thumb, and which grip comprises:

a) an elongated base having a central longitudinal axis and upper and lower opposed ends, and a series of generally transversely extending finger receiving grooves, each of which extends partially around said base, said grooves being spaced apart longitudinally on said base, the circumference of said base increasing upwardly from the lowermost groove to the uppermost groove, the base's reduced circumference allowing greater contraction of the small finger of the gripping hand at a joint between the phalanges and metacarpals, than the contraction of the comparable joints of the other three fingers of the gripping hand, on said base and b) a thumb support adjacent to said upper end of said base, said thumb support extending generally transverse to the axis of said base to one side of the axis having a slightly arcuate surface so as to position and support the thumb of the gripping hand in a bent position to one side of the axis with a bend in both joints of the thumb, wherein said handgrip has opposed upper and lower ends, and a throughbore is generally vertically disposed between said upper and lower ends, and wherein a member selected from the group consisting of a section of nylon webbing of a finite length and a section of elastic tubing of a finite length is disposed through said handgrip, each such section being greater than the elongation of said handgrip and having a first end and a second ends, wherein the generally vertical throughbore is disposed at an angle between 80 and 86 degrees, and further wherein the first end of said section is connected to the second end of said section to form an endless loop, the connected area being disposed up into the throughbore out of sight.

2. The hand exerciser of claim 1, further including a chrome ring disposed at the lower opposed end of said grip, wherein the first end of said finite section is disposed through the ring and sewn to itself for retention.

3. The hand exerciser of claim 1, further including a retainer having two slots and a divider with a set of teeth, disposed at the lower end of said grip, wherein the first end of said finite section passes through the first of said slots, around the divider and then back through the second of said slots and is retained by the teeth of said retainer at the lower opposed end of said grip.

4. An ergonomic hand exerciser which comprises: a modified elongated handgrip for being held in a hand of a user, which handgrip when disposed generally upright and gripped with the thumb of the user's hand prevents pronation of the first metacarpal and the thumb, and which grip comprises:

a) an elongated base having a central longitudinal axis and upper and lower opposed ends, and a series of generally transversely extending finger receiving grooves, each of which extends partially around said base, said grooves being spaced apart longitudinally on said base, the circumference of said base increasing upwardly from the lowermost groove to the uppermost groove, the base's reduced circumference allowing greater contraction of the small finger of the gripping hand at a joint between the phalanges and metacarpals, than the contraction of the comparable joints of the other three fingers of the gripping hand, on said base and b) a thumb support adjacent to said upper end of said base, said thumb support extending generally transverse to the axis of said base to one side of the axis having a slightly arcuate surface so as to position and support the thumb of the gripping hand in a bent position to one side of the axis with a bend in both joints of the thumb, wherein said handgrip has opposed upper and lower ends, and a throughbore is generally vertically disposed between said upper and lower ends, and wherein a member selected from the group consisting of a section of nylon webbing of a finite length and a section of elastic tubing of a finite length is disposed through said handgrip, each such section being greater than the elongation of said handgrip and having a first end and a second end;

wherein each connection between the finite section and the flexible tubing, at each of the two ends of the flexible tubing, comprises the combination of the finite section being disposed through a toothed retainer, and a knot in the tubing;

one of said handgrips being configured for the left hand and one of said handgrips being configured for the right hand, wherein the first and second ends of said finite section disposed through the grip configured for the right hand are both connected to one end of a length of flexible tubing, and the first and second ends of a said finite section disposed though the grip configured for the left hand are both connected to the other end of a length of flexible tubing;

wherein each connection between the finite section and the flexible tubing, at each of the two ends of the flexible tubing, comprises the combination of the finite section being disposed through a toothed retainer, and a knot in the tubing.

5. The hand exerciser of claim 4, wherein the flexible tubing is looped around and over a swivel split ring which swivel split ring can be attached to other objects for the carrying out of exercises.

6. The hand exerciser of claim 4, wherein each grip, further includes a bored upstanding section disposed on top of and integral to the upper opposed end, the bore thereof being in alignment with the throughbore said upstanding section being present to maintain the finite section passing through said grip away from the hand of the user.

7. An ergonomic hand exerciser which comprises: a modified elongated handgrip for being held in a hand of a user, which handgrip when disposed generally upright and gripped with the thumb of the user's hand prevents pronation of the first metacarpal and the thumb, and which grip comprises:

a) an elongated base having a central longitudinal axis and upper and lower opposed ends, and a series of generally transversely extending finger receiving grooves, each of which extends partially around said base, said grooves being spaced apart longitudinally on said base, the circumference of said base increasing upwardly from the lowermost groove to the uppermost groove, the base's reduced circumference allowing greater contraction of the small finger of the gripping hand at a joint between the phalanges and metacarpals, than the contraction of the comparable joints of the other three fingers of the gripping hand, on said base and b) a thumb support adjacent to said upper end of said base, said thumb support extending generally transverse to the axis of said base to one side of the axis having a slightly arcuate surface so as to position and support the thumb of the gripping hand in a bent position to one side of the axis with a bend in both joints of the thumb, wherein said handgrip has opposed upper and lower ends, and a throughbore is generally vertically disposed between said upper and lower ends, and wherein a member selected from the group consisting of a section of nylon webbing of a finite length and a section of elastic tubing of a finite length is disposed through said handgrip, each such section being greater than the elongation of said handgrip and having a first end and a second end;

wherein each connection between the finite section and the flexible tubing, at each of the two ends of the flexible tubing, comprises the combination of the finite section being disposed through a toothed retainer, and a knot in the tubing;

wherein an adapter having a downwardly depending cylindrical insert section to retain the adapter in position by friction fit in the bore is disposed over the upper opposed end of the grip to maintain the finite section passing through the grip away from the user.

8. The hand exerciser of claim 7, wherein the grip further includes a bored upstanding section disposed on top of and integral to the upper opposed end, the bore thereof being in alignment with the throughbore said upstanding section being present to maintain the finite section passing through said grip away from the hand of the user.

9. A modified elongated handgrip for being held in a hand of a user, which handgrip when disposed generally upright and gripped with the thumb of the user's hand prevents pronation of the first metacarpal and the thumb, and which grip comprises:

a) an elongated base having a central longitudinal axis and upper and lower opposed ends, and a series of generally transversely extending finger receiving grooves, each of which extends partially around said base, said grooves being spaced apart longitudinally on said base, the circumference of said base increasing upwardly from the lowermost groove to the uppermost groove, the base's reduced circumference allowing greater contraction of the small finger of the gripping hand at a joint between the phalanges and metacarpals, than the contraction of the comparable joints of the other three fingers of the gripping hand, on said base and b) a thumb support adjacent to said upper end of said base, said thumb support extending generally transverse to the axis of said base to one side of the axis having a slightly arcuate surface so as to position and support the thumb of the gripping hand in a bent position to one side of the axis with a bend in both joints of the thumb, wherein said handgrip has opposed upper and lower ends, and a throughbore is generally vertically disposed between said upper and lower ends, and wherein a member selected from the group consisting of a section of nylon webbing of a finite length and a section of elastic tubing of a finite length is disposed through said handgrip, each such section being greater than the elongation of said handgrip and having a first end and a second end;

wherein one of said handgrips being configured for the left hand and one of said handgrips being configured for the right hand, wherein the first and second ends of said finite section disposed through the grip configured for the right hand are both connected to one end of a length of flexible tubing, and the first and second ends of a said finite section disposed though the grip configured for the left hand are both connected to the other end of a length of flexible tubing; and wherein each grip further includes an adapter having a downwardly depending cylindrical insert section to retain the adapter in position by friction fit in the bore is disposed over the upper opposed end of the grip to maintain the finite section passing through the grip away from the user.

10. A hand exerciser comprising two modified elongated handgrips one of said handgrips being configured for the left hand and one of said handgrips being configured for the right hand, wherein both handgrips have opposed upper and lower ends, and a throughbore generally vertically disposed between said upper and lower ends;

wherein first and second ends of a finite section of webbing of an elongation greater than that of the grip are disposed through opposite ends of the grip configured for the right hand are both connected to one end of a length of flexible tubing, and first and second ends of a finite section of webbing of an elongation greater than that of the grip are disposed through opposite ends of the grip configured for the left hand are both connected to the other end of the same length of flexible tubing;

and wherein each of the modified elongated handgrips when disposed generally upright and gripped with the thumb of the user's hand prevents pronation of the first metacarpal and the thumb, said grips being connected together by and which grip comprises:

a) an elongated base having a central longitudinal axis and upper and lower opposed ends, and a series of generally transversely extending finger receiving grooves, each of which extends partially around said base, said grooves being spaced apart longitudinally on said base, the circumference of said base increasing upwardly from the lowermost groove to the uppermost groove, the base's reduced circumference allowing greater contraction of the small finger of the gripping hand at a joint between the phalanges and metacarpals, than the contraction of the comparable joints of the other three fingers of the gripping hand on said base; and b) a thumb support adjacent to said upper end of said base, said thumb support extending generally transverse to the axis of said base to one side of the axis having a slightly arcuate surface so as to position and support the thumb of the gripping hand in a bent position to one side of the axis with a bend in both joints of the thumb.

11. The hand exerciser of claim 10, wherein the said base of each grip has a generally sidewardly directed portion contoured for engaging so as to position and support the areas of the inside of the gripping hand generally aligned with the knuckle joint.

12. The hand exerciser of claim 11, wherein said generally sidewardly directed portion of the grip includes an elongated generally upright recess for receiving at least the knuckle joints of the first and index fingers of the hand so as to maintain said joints generally aligned with one another.

13. The hand exerciser of claim 10, wherein the flexible tubing is connected at about the midpoint thereof to a swivel split ring.

14. The hand exerciser of claim 10, wherein each grip includes a bored adaptor disposed in the upper end of said grip to keep the webbing away from each of the hands of the user.

15. The hand exerciser of claim 10, wherein the upper opposed end of each grip includes an integral upstanding bored section to keep the webbing away from each of the hands of the user.

16. A hand exerciser comprising two modified elongated handgrips one of said handgrips being configured for the left hand and one of said handgrips being configured for the right hand, wherein both handgrips have opposed upper and lower ends, and a throughbore generally vertically disposed between said upper and lower ends;

wherein first and second ends of a finite section of webbing of an elongation greater than that of the grip are disposed through opposite ends of the grip configured for the right hand and the second end is connected to one end of a length of flexible tubing, and first and second ends of a finite section of webbing of an elongation greater than that of the grip are disposed through opposite ends of the grip configured for the left hand and the second end is connected to the other end of the same length of flexible tubing; each first end being secured beneath the lower opposed end of the respective grip;

wherein each of the modified elongated handgrips when disposed generally upright and gripped with the thumb of the user's hand prevents pronation of the first metacarpal and the thumb, said grips being connected together by and which grip comprises:

a) an elongated base having a central longitudinal axis and upper and lower opposed ends, and a series of generally transversely extending finger receiving grooves, each of which extends partially around said base, said grooves being spaced apart longitudinally on said base, the circumference of said base increasing upwardly from the lowermost groove to the uppermost groove, the base's reduced circumference allowing greater contraction of the small finger of the gripping hand at a joint between the phalanges and metacarpals, than the contraction of the comparable joints of the other three fingers of the gripping hand on said base; and b) a thumb support adjacent to said upper end of said base, said thumb support extending generally transverse to the axis of said base to one side of the axis having a slightly arcuate surface so as to position and support the thumb of the gripping hand in a bent position to one side of the axis with a bend in both joints of the thumb.

* * * * *